US005094771A

United States Patent [19]

Ahmed et al.

[11] Patent Number: 5,094,771

[45] Date of Patent: Mar. 10, 1992

[54] NONAQUEOUS LIQUID AUTOMATIC DISHWASHER DETERGENT COMPOSITION

[75] Inventors: Fahim U. Ahmed, Dayton; Charles E. Buck, Caldwell; Gary Jakubicki, Robbinsville, all of N.J.

[73] Assignee: Colgate-Palmolive Co., Piscataway, N.J.

[21] Appl. No.: 520,337

[22] Filed: May 7, 1991

[51] Int. Cl.[5] ..... C11D 3/12; C11D 3/43; C11D 3/395; C11D 3/08

[52] U.S. Cl. ..... 252/99; 252/103; 252/104; 252/135; 252/136; 252/139; 252/140; 252/526; 252/174.21; 252/174.73; 252/174.24

[58] Field of Search ..... 252/135, 135, 103, 174.21, 252/140, 99, 174.25, 174.24, 174.23, 135, 526, 139, 104

[56] References Cited

U.S. PATENT DOCUMENTS

| | | | |
|---|---|---|---|
| 3,630,929 | 12/1971 | Van Dijk | 252/136 |
| 4,326,979 | 4/1982 | Bus | 252/135 |
| 4,539,144 | 9/1985 | de Ridder | 252/526 |
| 4,753,748 | 6/1988 | Laitem | 252/135 |

FOREIGN PATENT DOCUMENTS

| | | |
|---|---|---|
| 0314050 | 3/1989 | European Pat. Off. . |
| 0314061 | 3/1989 | European Pat. Off. . |
| 0315024 | 10/1989 | European Pat. Off. . |

*Primary Examiner*—Paul Lieberman
*Assistant Examiner*—Erin Higgins
*Attorney, Agent, or Firm*—Richard E. Nanfeldt; Robert C. Sullivan; Murray Grill

[57] ABSTRACT

The application is directed to a nonaqueous liquid automatic dishwasher detergent composition with improved anti-filming and anti-spotting properties and to a method of using the detergent composition. The detergent composition comprises a nonaqueous organic carrier liquid, silica, alumina or titanium dioxide anti-filming agent, a water soluble polyacylate anti-spotting agent, inorganic builder salts, bleach compound and detergent. The compositions provide reduced filming and spotting on dishware, glassware, china and the like, particularly in hard water. The nonaqueous liquid automatic dishwasher detergent compositions are stable in storage and are readily dispersible in water.

17 Claims, No Drawings

NONAQUEOUS LIQUID AUTOMATIC DISHWASHER DETERGENT COMPOSITION

RELATED APPLICATIONS

This application is related to applications Ser. No. 323,138 filed Mar. 13, 1989, Ser. No. 323,126, filed Mar. 10, 1989, now U.S. Pat. No. 4,889,653, Ser. No. 323,134, filed Mar. 13, 1989 and Ser. No. 323,137, filed Mar. 13, 1989 all of which are directed to aqueous automatic dishwasher detergent compositions containing an anti-filming agent or an anti-filming and anti-spotting agent.

FIELD OF THE INVENTION

The present invention relates to an automatic dishwasher detergent composition having improved anti-filming and/or anti-spotting properties. The present invention is particularly directed to a stable nonaqueous liquid dishwasher detergent composition containing an anti-filming and/or anti-spotting agent for use in an automatic dishwasher to clean dishware, glassware and the like.

The present invention more particularly relates to a nonaqueous liquid dishwashing detergent composition with improved anti-filming and anti-spotting properties and to a method of using the detergent composition to clean dishware, glassware, china and the like. The dishwashing composition contains an anti-filming agent, or an anti-filming agent and poly acrylic acid polymer or salt anti-spotting agent, inorganic builder salts, bleach compound and detergent.

The detergent dishwashing composition of the present invention reduce filming and/or spotting on dishware, glassware, china and the like, particularly in hard water at low temperature.

More specifically, the invention relates to the use of a nonabrasive amount of small substantially water insoluble silica particles, as an anti-filming agent and polyacrylic acid or salt polymer as an anti-spotting agent in nonaqueous liquid dishwashing detergent compositions to reduce filming and/or spotting.

The detergent compositions do not require an added rinse aid, are stable in storage and are readily dispersible in the wash bath.

The present invention specifically relates to nonaqueous liquid automatic dishwashing detergent compositions having improved anti-filming properties, which are readily dispersible in the washing medium to provide effective cleaning of dishware, glassware, china and the like.

The present invention also relates to an improved nonaqueous liquid composition and to a method of using the composition.

BRIEF DESCRIPTION OF THE INVENTION

The present invention is directed to a nonaqueous liquid automatic dishwasher detergent composition having improved anti-filming and/or anti-spotting properties for cleaning of dishware, glassware, china and the like. The detergent composition contains as an essential ingredient a nonabrasive amount of small substantially water insoluble silica, alumina or titanium dioxide particles as an anti-filming agent. The compositions can additionally contain a polyacrylic acid polymer or salt as an anti-spotting agent.

The present invention specifically relates to nonaqueous liquid automatic dishwashing detergent compositions having improved anti-filming and/or anti-spotting properties for cleaning of dishware, glassware, china and the like.

The nonaqueous liquid compositions are stable in storage, do not settle, are readily pourable and are readily dispersed in water.

PRIOR ART

Commercially available household-machine dishwasher detergents provided in powder or liquid form have many disadvantages. Commercially available powder detergents have the disadvantages of non-uniform composition; costly operations necessary in their manufacture; tendency to cake in storage at high humidities, resulting in the formation of lumps which are difficult to disperse; dustiness, a source of particular irritation to users who suffer allergies; and tendency to cake in the dishwasher machine dispenser.

In addition, the commercially available formulated powder detergents frequently require a separate step of hand towel wiping and drying of the dishware, glassware, china and the like to avoid leaving undesirable traces or film. The use of liquid detergent compositions present other problems. The builder salts settle in storage and are not readily redispersed. The compositions also frequently become thicker in storage and are not readily pourable.

For effective use, it is generally recommended that the automatic dishwashing detergent, hereinafter also designated ADD, contain (1) sodium tripolyphosphate (NaTPP) to soften or tie up hard-water minerals and to emulsify and/or peptize soil; (2) sodium silicate to supply the alkalinity necessary for effective detergency and to provide protection for dishware, such as fine china and protection against machine corrosion; (3) sodium carbonate, generally considered to be optional, to enhance alkalinity; (4) a chlorine-releasing agent to aid in cleaning; (5) a surfactant and (6) a defoamer to reduce foam, thereby enhancing machine efficiency. See, for example, SDA Detergents in Depth, "Formulations Aspects Of Machine Dishwashing," Thomas Oberle (1974). Cleansers approximating to the afore-described compositions are mostly liquids or powders. Generally, such compositions omit hypochlorite bleach, since it tends to react with other chemically active ingredients, particularly surfactant, thereby impairing its effectiveness.

U.S. Pat. No. 3,985,668 describes abrasive scouring cleaners of gel-like consistency containing (1) suspending agent, preferably the Smectite and attapulgite types of clay; (2) abrasive, e.g. silica sand or perlite; and (3) filler comprising light density powdered polymers, expanded perlite and the like. The perlite has a bouyancy and thus stabilizing effect on the composition in addition to serving as a bulking agent, thereby replacing water otherwise available for undesired supernatant layer formation due to leaking and phase destabilization. The foregoing are the essential ingredients. Optional ingredients include hypochlorite bleach, bleach stable surfactant and buffer, e.g. silicates, carbonates, and monophosphates. Builders, such as NaTPP, can be included as further optional ingredients to supply or supplement building function not provided by the buffer, the amount of such builder not exceeding 5% of the total composition, according to the patent. Maintenance of the desired (greater than) pH 10 levels is achieved by the buffer/builder components. High pH is said to minimize decomposition of chlorine bleach and undesired interaction between surfactant and bleach. When present, NaTPP is limited to 5%, as stated. Foam killer is not disclosed.

U.S. Pat. No. 4,511,487 dated Apr. 16, 1985 describes a low-foaming detergent paste for dishwashers. The composition is based on a mixture of finely divided hydrated sodium metasilicate, an active chlorine compound and a thickening agent which is a foliated silicate of the hectorite type. Small amount of nonionic tensides and alkali metal carbonates and/or hydroxides may be used.

The Laitem et al U.S. Pat. No. 4,753,748 discloses a nonaqueous liquid automatic dishwashing detergent composition comprising a liquid nonionic surfactant containing a stable or readily redispersible suspension of a polyphosphate builder and/or citrate salt and an alkylene glycol mono alkyl ether anti-gel agent.

Scott U.S. Pat. No. 4,438,014 discloses a powder formulation containing a novel nonionic surfactant for automatic dishwasher detergent compositions. The nonionic surfactant consists of an alkyl group to which there is directly attached a propylene oxide polymer to which is attached an ethylene oxide-propylene oxide random copolymer. The nonionic surfactant is described as providing optimum cleaning and good spotting and film results and good defoaming power.

ADVANTAGES OVER THE PRIOR ART

The nonaqueous liquid detergent compositions of the present invention overcome many of the prior art problems associated with powder and liquid detergents. Because of the addition of a small effective amount of a silica, alumina or titanium dioxide anti-filming agent or silica and polyacrylic acid polymer or salt anti-spotting agent to the composition an added rinse aid is not required and towel wiping and drying are not required to obtain dry sparkling clean dishes, glasses, cups and eating utensils.

The nonaqueous liquid automatic dishwashing detergent compositions of the present invention have the advantages of being stable, nonsettling in storage, and non-gelling in storage, and are readily dispersible in the dishwashing machine. The liquid compositions of the present invention are easily pourable, easily measured and easily put into dishwashing machines.

Further, because the dishwashing machines as built and marketed have a built in volume space in which the detergent is placed, the concentrated nature of the liquid detergent concentrate composition of the present invention allows placing in the dishwashing machine more active liquid detergent, e.g. more dispersed polyphosphate and other detergent builders.

The nonaqueous liquid detergent compositions of the present invention with the exception of the anti-film agent, are readily soluble in the wash water in the dishwashing machine.

OBJECTS OF THE PRESENT INVENTION

It is an object of the present invention to provide a nonaqueous liquid automatic dishwasher detergent composition that has improved anti-filming and/or anti-spotting properties.

It is another object of the invention to provide a nonaqueous liquid detergent composition which is stable in storage, does not degrade or decompose, is easily pourable, is readily dispersible and is readily soluble in the dishwashing water.

A further object of the invention is to provide a method of washing dishware, glassware, china and the like in an automatic dishwashing machine using a nonaqueous liquid detergent composition in which a separate rinse aid is not added or needed.

A still further object of the invention is to provide a method of washing dishware, glassware, china and the like in an automatic washing machine using a nonaqueous liquid detergent composition by which method the dishware, glassware, china and the like are machine dried with reduced film and/or spots.

It is a further object of this invention to provide an improved nonaqueous liquid detergent composition, especially an automatic dishwasher detergent composition, by incorporating in the composition a small effective amount of a silica anti-filming agent or silica and polyacrylic acid polymer or salt as anti-filming and anti-spotting agents.

DETAILED DESCRIPTION OF THE INVENTION

These and other objects of the invention which will become more readily understood from the following detailed description of the invention and preferred embodiments thereof which are achieved by incorporating in a nonaqueous liquid detergent composition a small but effective amount of a silica, alumina or titanium dioxide anti-filming agent or silica anti-filming agent and polyacrylic acid polymer or salt anti-spotting agent. More particularly, in a preferred and specific embodiment of the invention, there is provided a nonaqueous liquid automatic dishwasher detergent composition in which is incorporated from about 0.5 to 10% of a silica anti-filming agent or silica anti-filming agent and 1 to 30% of a water soluble polyacrylic acid polymer or salt anti-spotting agent. The silica anti-filming agent has a particle size of about 0.1 to 10 microns. The water soluble polyacrylic acid or salt polymer has a molecular weight of about 1000 to 100,000.

In accordance with the present invention there is provided a nonaqueous liquid automatic dishwasher detergent composition which includes, on a weight basis;

(a) 20 to 60% organic carrier liquid;
(b) 20 to 60% organic or inorganic builder salt;
(c) 5 to 30% sodium silicate;
(d) 3 to 15% peroxygen bleach compound;
(e) 0 to 8% bleach activator;
(f) 0.5 to 10% silica anti-filming agent;
(g) 0 to 30% polyacrylic acid polymer or salt;
(h) 0 to 25% alkali metal carbonate;
(i) 0.1 to 12% water dispersible organic detergent active material; and
(j) 0 to 6% foam depressant.

The present invention also provides a method for cleaning dishware, glassware, china and the like in an automatic dishwashing machine with an aqueous wash bath containing an effective amount of the nonaqueous liquid automatic dishwasher detergent (LADD) composition as described above. According to this aspect of the invention, the LADD composition is stable in storage, is easily measured and can be readily poured into the automatic dishwashing machine.

The invention will now be described in greater detail by way of specific embodiments thereof.

In accordance with the present invention an improved automatic dishwasher detergent composition is prepared by incorporating small amounts of a silica anti-filming agent or silica anti-filming agent and polyacrylic acid polymer or salt in a dishwasher composition.

The present invention is based upon the discovery that substantially improved anti-filming and/or anti-spotting properties can be obtained by adding to the nonaqueous liquid detergent composition a small effective amount of a silica anti-filming agent or silica anti-filming agent and polyacrylic acid polymer or salt anti-spotting agent.

In accordance with an embodiment of the present invention a nonaqueous liquid automatic dishwashing detergent composition is prepared by dispersing a polyphosphate builder in an organic carrier liquid. The polyphosphate builder may be replaced in whole or in part by an organic builder.

In addition other ingredients can be added to the composition such as anti-encrustation agents, anti-foam agents, optical brighteners, enzymes and perfume.

Organic Carrier Liquids

The organic carrier liquids that can be used in accordance with the present invention are carrier liquids, diluents and solvents that are compatible with the composition ingredients. Suitable organic carrier liquids are polyethylene glycol M.W. 300, M.W. 400 and M.W. 4000, propylene glycol, propylene carbonate, polypropylene glycol M.W. 200 and M.W. 300, methoxy propylene glycol, Carbowax MPEG 350 (polyethylene glycol methyl ether), from Union Carbide, triethanol amine, Butyl Carbitol, from DuPont Co, Glyme (ethylene glycol dimethyl ether), Diglyme (diethylene glycol dimethyl ether).

There can also be used as organic carrier liquids the alkylene glycol monoalkyl ethers. The alkylene glycol mono alkyl ethers are low molecular weight amphiphilic compounds, particularly a mono-, di- or tri lower ($C_2$ to $C_3$) alkylene glycol mono lower ($C_1$ to $C_5$) alkyl ether. Suitable examples of such additive amphiphilic compounds are ethylene glycol monoethyl ether $C_2H_5—O—CH_2CH_2OH$, diethylene glycol monobutyl ether $C_4H_9—O—(CH_2CH_2O)_2H$ and dipropylene glycol monomethyl ether $$CH_3—O—(CH_2\underset{\underset{CH_3}{|}}{C}HO)_2H.$$

The above discussed organic carrier liquids can be used alone or in admixture in order to obtain a desired viscosity and stability of the product liquid.

The compositions of the present invention have good viscosity and stability characteristics and remain stable and pourable at low temperatures.

Liquid Nonionic Surfactant Detergents

The liquid nonionic surfactant detergents that can be used in the practice of the present invention are preferably the low foam poly-lower alkoxylated lipophiles.

Useful nonionics are represented by the low foam Plurafac series from BASF Chemical Company which are the reaction product of a higher linear alcohol and a mixture of ethylene and propylene oxides, containing a mixed chain of ethylene oxide and propylene oxide, terminated by a hydroxyl group. Examples include a $C_{13}$–$C_{15}$ fatty alcohol condensed with 6 moles ethylene oxide and 3 moles propylene oxide, a $C_{13}$–$C_{15}$ fatty alcohol condensed with 7 moles propylene oxide and 4 moles ethylene oxide and a $C_{13}$–$C_{15}$ fatty alcohol condensed with 5 moles propylene oxide and 10 moles ethylene oxide.

Other useful surfactants are Neodol 25-7 and Neodol 23-6.5, which products are made by Shell Chemical Company, Inc. The former is a condensation product of a mixture of higher fatty alcohols averaging about 12 to 15 carbon atoms, with about 7 moles of ethylene oxide and the latter is a corresponding mixture wherein the carbon atom content of the higher fatty alcohol is 12 to 13 and the number of ethylene oxide groups present averages about 6.5. The higher alcohols are primary alkanols. Other examples of such detergents include Tergitol 15-S-7 and Tergitol 15-S-9 (registered trademarks), both of which are linear secondary alcohol ethoxylates made by Union Carbide Corp. The former is mixed ethoxylation product of 11 to 15 carbon atoms linear secondary alkanol with seven moles of ethylene oxide and the latter is a similar product but with nine moles of ethylene oxide being reacted.

A nonionic surfactant that can be used is available from Union Carbide Corporation under the trademark Tergitol MDS-42. This nonionic surfactant is a $C_{12}$–$C_{14}$ linear alcohol containing 55% by weight random distributed oxyalkyl groups of which 42% are ethoxy and 58% propoxy groups.

A preferred nonionic surfactant that can be used in accordance with the present invention has the following formula $$R\text{-}O\text{-}(PO)_x\text{-}(EO/PO)H$$

R is an alkyl group having 8 carbon atoms, PO is a propylene oxide polymer attached directly to the oxygen of the alkyl group, x is 8 to 9, EO/PO represents a copolymer of ethylene oxide and propylene oxide in which the ethylene oxide and propylene oxide are randomly mixed. The molar ratio of EO/PO is about 2:1 to 5:1, e.g. about 3:1. The total number of EO and PO groups in the copolymer are such that the number of EO and PO groups are 5 to 8 and the cloud point of the nonionic surfactant is about 20° to 30° C.

A method of making the nonionic surfactant and a more complete description of the nonionic surfactant is given in the Scott U.S. Pat. No. 4,438,014 which is incorporated herein in its entirety.

Other useful nonionic surfactants are the Poly-Tergent S-LF surfactants available from Olin Corporation. These surfactants are low foaming, biodegradable linear fatty alcohols. Surfactants of this type are available under the tradenames Poly-Tergent S-LF 18, Poly-Tergent S-305-LF, Poly-Tergent S-405-LF and Poly-Tergent CS-1.

Mixtures of two or more of the liquid nonionic surfactants can be used and in some cases advantages can be obtained by the use of such mixtures.

In addition, the above discussed nonionic surfactants, anionic surfactants can also be used.

Anionic Surfactants

The anionic surfactants that can be used are the linear or branched alkali metal mono- and/or di-($C_{8-14}$) alkyl diphenyl oxide mono and/or disulphonates, commercially available for example as DOWFAX (Registered Trademark) 3B-2 and DOWFAX 2A-1.

Other suitable surfactants include the primary alkylsulphates, alkylsulphonates, alkylaryl-sulphates and sec. alkylsulphates. Examples include sodium $C_{10-18}$ alkylsulphates such as sodium dodecylsulphate and sodium tallow alcoholsulphate: sodium $C_{10-18}$ alkanesulphonates such as sodium hexadecyl-1-sulphonate and sodium $C_{12-18}$ alkylbenzenesulphonates such as sodium dodecylbenzenesulphonates. The corresponding potassium salts may also be employed.

Surfactants of the foregoing type, all well known in the art, are described, for example, in U.S. Pat. Nos. 3,985,668 and 4,271,030, which are incorporated herein by reference thereto.

The nonionic and anionic surfactants are used in amounts of 0.1 to 12%, preferably 0.5 to 10.0%, and more preferably about 1.0 to 8.0%, for example 2 to 7%.

ANTI-FILMING AGENTS

The anti-filming agent comprises a nonabrasive amount of small substantially water insoluble silica particles. There can also be used as anti-filming agents alumina and titanium dioxide particles. The anti-filming agent accordingly can be a member selected from the group consisting of silica, alumina and titanium dioxide and mixtures thereof.

Silica

The silica anti-filming agent materials that can be used are fumed or precipitated synthetic or natural silica. The silica may be amorphous or crystalline.

The silica material that is used may contain up to about 0.1 to 5% alumina ($Al_2O_3$), usually up to about 0.5 to 3% and more usually about 1% alumina, based on the weight of silica.

A preferred silica material is Syloid 244 which is amorphous silica, has a particle size of about 4 microns and is provided by W. R. Grace Co. Another suitable silica material is Silox 15, also from W. R. Grace Co., which has a particle size of about 4 microns.

Another preferred silica material is Huber Zeo 49 which is amorphous silica and is provided by J. M. Huber Corporation and contains about 1% alumina ($Al_2O_3$).

The particle size of the silica material that is used is important in achieving the desired anti-filming properties.

The silica particles that are used are finely divided and can have a particle size of about 0.10 to 10 microns, preferably 0.50 to 8 microns and more preferably about 1.0 to 5.0 microns. The silica particles of this size and the amount used herein are not abrasive.

The finely divided silica material particles in the dishwashing wash act to coagulate proteinaceous particulate soils and keeps them in suspension to prevent them from depositing on the clean glass and dishware to form a film.

Alumina

The alumina material that can be used as an anti-filming agent is commercially available and is insoluble in water and has the formula $Al_2O_3$. Suitable materials are available under the tradenames Alumina Oxide C, available from Degussa Company and Catapal D, available from Vista Corp. Preferred alumina materials are fumed alumina and a precipitated alumina.

Titanium Dioxide

The titanium dioxide material that can be used as an anti-filming agent is insoluble in water and has the formula $TiO_2$. Suitable materials are available under the tradenames Titanium Dioxide P25, available from Degussa Co. Preferred titanium dioxide materials are fumed titanium dioxide and precipitated titanium dioxide.

The particle size of the alumina and titanium dioxide material that are used is important in achieving the desired anti-filming properties.

The alumina or titanium dioxide particles that are used are finely divided and can have a particle size of about 0.01 to 10 microns, preferably 0.01 to 8 microns and more preferably about 0.020 to 4.0 microns. For example, a suitable particle size is about 0.01 to 0.50 microns. The alumina and titanium dioxide particles of this size and in the amount used herein are not abrasive.

The finely divided alumina or titanium dioxide material particles in the dishwashing wash act to coagulate proteinaceous particulate soils and keeps them in suspension to prevent them from depositing on the clean glass and dishware.

Without intending to limit the invention in anyway it is theorized that the alumina and titanium dioxide anti-filming agents function in the following manner. The surface of vitreous glassware contains negatively charged sites through the Si-O bonds. Usually the oxygen atoms carry these charges. It is postulated that these negatively charged ions will attract positively charged particles and thereby will form an "artificial soil" layer. This protective mono-layer will then repel the regular food soil and will increase the anti-redeposition property of the automatic dishwashing detergent. The alumina and titanium dioxide particles, respectively, will generate positively charged particles which will bond themselves to the glassware surface to form the artificial soil layer which will prevent the formation of film.

The amount of silica, alumina or titanium dioxide anti-filming agent that can be used to achieve the desired improvement in film will depend on the hardness of the water, detergent active compound, inorganic salts and other ADD ingredients. The silica, alumina or titanium dioxide anti-filming agents are particularly effective in hard wash water of, for example, 300 ppm hardness or more.

The amount of each of the silica, alumina or titanium dioxide anti-film agent that is used can be about 0.5 to 10%, preferably about 1 to 8% and more preferably about 1.5 to 6% by weight based on the weight of the entire composition.

The silica, alumina and titanium dioxide can each be used alone or one or more of them can be used mixed together. When the anti-filming agents are used mixed together the weight percent amounts mentioned above are the total for the anti-film agent ingredients used in the mixture.

ANTI-SPOTTING AGENTS

Polyacrylic Acid Polymers And Salts Thereof

The polyacrylic acid polymers and salts thereof anti-spotting agents that can be used are generally commercially available and are briefly described as follows.

The polyacrylic acid polymers and salts thereof that can be used comprise water soluble low molecular weight polymers having the formula

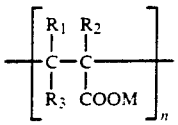

wherein the $R_1$, $R_2$ and $R_3$ can be the same or different and can be hydrogen, $C_1$–$C_4$ lower alkyl, or combinations thereof. The value of n is 5 to 1000, preferably, 10 to 500, and more preferably 20 to 100. M represents hydrogen, or an alkali metal such as sodium or potassium. The preferred substituent for M is sodium.

The preferred $R_1$, $R_2$ and $R_3$ groups are hydrogen, methyl, ethyl and propyl. Preferred acrylic acid monomer is one where $R_1$ to $R_3$ are hydrogen, e.g. acrylic acid, or where $R_1$ and $R_3$ are hydrogen and $R_2$ is methyl, e.g. methyl acrylic acid monomer.

The degree of polymerization, i.e. the value of n, is generally determined by the limit compatible with the solubility of the polymer in water. The terminal or end groups of the polymer are not critical and can be H, OH, $CH_3$ or a low molecular weight hydrocarbon.

The polyacrylic acid polymers and salts thereof can have a molecular weight of 500 or 1,000 to 100,000, preferably 1,500 to 80,000 and especially preferably 2,000 to 50,000.

Specific polyacrylic acid polymers which can be used include the Acrysol LMW acrylic acid polymers from Rohm and Haas, such as the Acrysol LMW-45N, a neutralized sodium salt, which has a molecular weight of about 4,500 and Acrysol LMW-20NX, a neutralized sodium salt, which has a molecular weight of about 2,000. Other polyacrylic acid polymers or salts thereof that can be used are: Alcosperse 149, molecular weight 2000, Alcosperse 123, molecular weight 4500, Alcosperse 107, molecular weight 3000, Alcosperse 124, molecular weight 2000, and Alcosperse 602N molecular weight 4500, all of which are available from Alco Chemical Corp. The low molecular weight acrylic acid polymers can, for example, have a molecular weight of about 1,000 to 10,000. Another polyacrylic acid polymer that can be used is Alcosperse 110 (from Alco) which is a sodium salt of an organic polycarboxylate and which has a molecular weight of about 100,000.

The above polyacrylic acid polymers and salts thereof can be made using procedures known in the art, see for example U.S. Pat. No. 4,203,858.

The amount of polyacrylic acid polymer or salt that can be used to achieve the desired improvement in anti-filming and anti-spotting properties will depend on the hardness of the water, detergent active compound, inorganic salts and other ADD ingredients.

The polyacrylic acid or salt anti-spotting agent is particularly effective in reducing spotting in hard water of, for example, 300 ppm hardness or more.

Generally, the amounts of the polyacrylic acid polymer or salt anti-spotting agent that can be used are in the range of from about 1.0 to 30%, preferably from about 2.0 to 25%, especially preferably about 4 to 20%.

BUILDER SALTS

Generally, ADD effectiveness is related to (a) oxygen bleach levels; (b) alkalinity; (c) solubility in washing medium; and (d) foam inhibition. It is preferred herein that the pH of the aqueous wash bath after addition of the liquid ADD composition be at least about 9.5, more preferably from about 10.5 to 13.5 and most preferably at least about 11.5.

The amount of alkali metal silicate added and the amount of alkali metal TPP added can be used to obtain the desired alkalinity in the wash bath. The sodium carbonate can be added to act as a buffer to maintain the desired pH level in the wash bath. The sodium carbonate can be added in an amount of 0 to 25 wt. %, preferably 5 to 20 wt. % and typically about 5 to 15 wt. % of the detergent composition.

The compositions of the present invention can contain inorganic builder salts such as NaTPP or organic builder salts such as the alkali metal salts of polycarboxylic acids.

A preferred solid builder salt is an alkali metal polyphosphate such as sodium tripolyphosphate (TPP). In place of all or part of the alkali metal polyphosphate one or more other detergent builder salts can be used. Suitable other builder salts are alkali metal borates, phosphates and bicarbonates.

Specific examples of such builders are sodium tetraborate, sodium pyrophosphate, potassium pyrophosphate, sodium bicarbonate, sodium hexametaphosphate, sodium sesquicarbonate, sodium mono and diorthophosphate, potassium bicarbonate and sodium or potassium zeolites.

The detergent builders, e.g. NaTPP may be employed in the nonaqueous liquid ADD composition in a range of 20 to 60%, preferably about 20 to 55 wt. %, and more preferably about 20 to 45 wt. %. The NaTPP may be anhydrous or hydrated, including the stable hexahydrate with a degree of hydration of 6 corresponding to about 18% by weight of water or more. However, anhydrous NaTPP is preferred.

The NaTPP may be replaced in whole or in part by organic builder salts. Since the compositions of this invention are generally highly concentrated, and, therefore, may be used at relatively low dosages, it is desirable to supplement any phosphate builder (such as sodium tripolyphosphate) with an auxiliary builder such as an alkali metal polycarboxylic acid. Suitable alkali metal polycarboxylic acids are alkali metal salts of citric and tartaric acid, e.g. monosodium and disodium citrate (anhydrous). The sodium salts of citric and tartaric acids are preferred.

Foam Inhibitors

Foam inhibition is important to increase dishwasher machine efficiency and minimize destabilizing effects which might occur due to the presence of excess foam within the washer during use. Foam may be sufficiently reduced by suitable selection of the type and/or amount of detergent active material, the main foam-producing component. The degree of foam is also somewhat dependent on the hardness of the wash water in the machine whereby suitable adjustment of the proportions of NaTPP which has a water softening effect may aid in providing the desired degree of foam inhibition. However, it is generally preferred to include a foam depressant or inhibitor. Particularly effective are the alkyl phosphonic acid esters of the formula

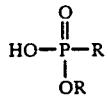

available, for example, from BASF-Wyandotte (PCUK-PAE), and especially the alkyl acid phosphate esters of the formula

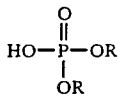

available, for example, from Hooker (SAP) and Knapsack (LPKN-158), in which one or both R groups in each type of ester may represent independently a $C_{12-20}$ alkyl group. Mixtures of the two types or mixtures of mono- and di-esters of the same type, may be employed. Especially preferred is a mixture of mono- and di-$C_{16-18}$ alkyl acid phosphate esters such as monostearyl/-distearyl acid phosphates 1.2/1 (Knapsack). When employed, proportions of 0.01 to 6 wt. %, preferably 0.1 to 5 wt. %, especially about 0.5 to 4.5 wt. %, of foam depressant in the composition is typical, the weight ratio of detergent active component to foam depressant generally ranging from about 10:1 to 1:1 and preferably about 4:1 to 1:1. Other defoamers which may be used include, for example, the known silicones, such as Dow Corning 1400 and 1500, which are polysiloxanes mixed with dispersed silica.

Bleaching Agents

The peroxygen bleach compounds are preferrably used in the compositions of the present invention. The oxygen bleaches are well known and are represented by percompounds which liberate hydrogen peroxide in solution. Preferred examples include sodium and potassium perborates, percarbonates, and perphosphates, and potassium monopersulfate. The perborates, particularly sodium perborate monohydrate, are preferred. The peroxygen compounds can be used in an amount of 3 to 15, preferably 4 to 12 and more preferably 4 to 8% by weight.

The peroxygen compound is preferably used in admixture with an activator therefor. Suitable activators which can lower the effective operating temperature of the peroxide bleaching agent are used. Polyacylated compounds are preferred activators; among these, compounds such as tetraacetyl ethylene diamine (TAED) and pentaacetyl glucose are particularly preferred. The bleach activators can be used in an amount of 0 to 8, preferably 1 to 8 and more preferably 2 to 6 wt. percent, for example 2 to 4 wt. percent.

The bleach activators interact with the peroxygen compounds to form a peroxyacid bleaching agent in the wash water.

Other useful activators include, for example, acetylsalicylic acid derivatives, ethylidene benzoate acetate and its salts, ethylidene carboxylate acetate and its salts, alkyl and alkenyl succinic anhydride, tetraacetylglycouril (TAGU), and the derivatives of these.

The conventionally used dishwasher detergent composition chlorine bleach compounds such as dichloroisocyanurate, alkali metal, e.g. potassium and sodium, hypochlorite should not be used because they are unstable in the organic carrier liquids used in the compositions of the present invention. That is compounds that contain hypochlorite or that generate hypochlorite in the product liquid should not be used. Compounds that are stable in the product liquid, but that develop hypochlorite ion in the dishwasher water can however be used. For example, a combination of sodium chloride and Oxone (TM for potassium mono persulfate) which develop hypochlorite ion in the dishwasher water can be used.

Sodium Silicate

The sodium silicate, which provides alkalinity and protection of hard surfaces, such as fine china, is employed in an amount ranging from about 5 to 30 wt. %, preferably about 7 to 26 wt. %, and more preferably about 8 to 24 wt. %, in the composition. For example the composition can contain 8 to 15% sodium silicate. The sodium silicate also protects the washing machine from corrosion. The sodium silicate can have a $Na_2O$:-$SiO_2$ ratio of 1.6/1 to 1/3.2. The sodium silicate can be added in the form of a dry powder or as a nonaqueous dispersion, preferably having an $Na_2O$:$SiO_2$ ratio of from 1/1 to 1/2.8, for example, 1/2.4. Potassium silicates of the same ratios can also be used. The preferred alkali metal silicates are anhydrous sodium disilicate and sodium metasilicate.

Most of the other components of the composition, for example, foam depressant can be added in the form of dry powders or nonaqueous dispersions or solutions.

The detergent active materials used in the present invention can be either the nonionic or anionic detergents. The nonionic detergents are, however, preferred.

Various conventional ingredients may be included in these compositions in small amounts, generally less than about 4 wt. %, e.g. 0.5 to 4% such as perfume, hydrotropic agents such as the sodium benzene, toluene, xylene and cumene sulphonates, preservatives, dyestuffs and pigments and the like. Especially preferred for coloring are the chlorinated phthalocyanines and polysulphides of aluminosilicate which provide, respectively, pleasing green and blue tints.

The nonaqueous liquid ADD compositions of this invention are readily employed in known manner for washing dishes, glasses, cups, eating utensils and the like in an aqueous wash bath, in an automatic dishwasher, containing an effective amount of the composition.

The composition may also include conventional organic or inorganic thickening agents in amounts sufficient to obtain a product consistency of a cream or a paste.

The thickening agents, i.e. thickeners or suspending agents which provide thickening properties, are known in the art and may be organic or inorganic, water soluble or insoluble, dispersible or colloid-forming, and monomeric or polymeric, and should of course be stable in these compositions, e.g. stable to alkalinity. The preferred thickeners generally comprise the inorganic, colloid-forming clays of smectite and/or attapulgite types. These materials are generally used in amounts of about 1.5 to 10, preferably 2 to 5 wt %, to confer the desired thickening properties to the formulation.

Smectite clays include montmorillonite (bentonite), hectorite, attapulgite, smectite, saponite, and the like. Montmorillonite clays are preferred and are available under tradenames such as Thixogel (Registered Trademark) No. 1 and Gelwhite (Registered Trademark) GP, H, etc., from Georgia Kaolin Company; and ECCAGUM (Registered Trademark) GP, H, etc., from Luthern Clay Products. Attapulgite clays include the materials commercially available under the tradename Attagel (Registered Trademark), i.e. Attagel 40, Attagel 50 and Attagel 150 from Engelhard Minerals and Chemicals Corporation. Bentone 27 and Betone 38 from NL Chemicals can also be used. Mixtures of smectite and attapulgite types in weight ratios of 4:1 to 1:5 are also useful. Thickening or suspending agents of the foregoing types are well known in the art, being described. for example, in U.S. Pat. No. 3,985,668, which is incorporated herein by reference thereto.

The nonaqueous liquid ADD compositions of this invention are readily employed in known manner for washing dishes, glasses, cups, cookware, eating utensils and the like in an automatic dishwasher, provided with a suitable detergent dispenser, in an aqueous wash bath containing an effective amount of the composition.

In an embodiment of the invention an automatic dishwashing detergent concentrate composition is formulated using the below named ingredients.

| Component | Weight Percent | Preferred Weight Percent |
|---|---|---|
| Organic Carrier Liquid | 20–60 | 30–45 |
| Sodium Tripolyphosphate | 20–60 | 20–45 |
| Sodium Carbonate | 0–25 | 5–15 |
| Surfactant Detergent | 1–12 | 3–8 |
| Sodium Silicate | 5–30 | 10–24 |
| Anti-filming Agent | 1–10 | 1.5–6 |
| Sodium Polyacrylate | 1–30 | 4–20 |
| Oxygen Bleach | 4–12 | 4–8 |
| Bleach Activator | 1–8 | 2–6 |
| Color, Perfume | 0–4 to 3.0 | 0.1–0.5 |
| Moisture | 0–3.0 | 0.1 to 0.5 |

The nonaqueous liquid dishwasher detergent compositions of the present invention can contain conventional dishwashing detergent composition additives. The formulations can be prepared with commercially available detergent builders, peroxygen bleach compounds and bleach activators and surfactant compounds.

The formulations can be prepared using the conventional blending and mixing procedures used for the preparation of liquid detergent compositions as briefly described below.

Method Of Preparation of Liquid Composition

The compositions of the present invention can be prepared in two stages. In the first stage silica, alumina or titanium dioxide anti-film agent, powdered silicate and low molecular weight polyacrylate powder (when used) are premilled using a ceramic ball mill. The premilled materials are then mixed using a standard rotary mixer. This mixed material is then transferred to an attritor and milled for 30 minutes at 500 rpm using ¼ inch stealite grinding media.

In the second stage the organic carrier liquid and Neodol 25-6.5 (nonionic surfactant) are mixed, and the defoamer and phosphate builder salts are added. The premilled anti-film agent and polyacrylate (when used) are then added to the organic carrier liquid and nonionic surfactant mixture followed by the addition of sodium carbonate, oxygen bleach and bleach activator and the remaining ingredients. After mixing the liquids solids mixture is vigorously stirred to obtain a stable dispersion of the solids in the organic carrier liquid.

One or more of the ingredients can be omitted or additional ingredients such as perfumes and anti-foam agents can be added to the composition.

The term nonaqueous liquid compositions as used herein is intended to include compositions containing 0–8% water, typically 2–6% and more typically 1–2% water. The water can be present in the form of hydrated compounds, i.e. bound water, for example, sodium tripolyphosphate hexahydrate, hydrated sodium carbonate, hydrated sodium sulfate, sodium perborate monohydrate and/or in the form of moisture, i.e. unbound water. It is preferred, however, that the composition contain less than 1% moisture as unbound water.

All amounts and proportions referred to herein are percent by weight of the composition unless otherwise indicated.

The invention may be put into practice in various ways and a number of specific embodiments will be described to illustrate the invention with reference to the accompanying examples.

EXAMPLE 1

In accordance with the present invention an aqueous liquid automatic dishwasher detergent composition was formulated using the below named ingredients in the amounts indicated and is compared with a prior art commercial powder detergent.

| Ingredient | A Invention Liquid (Parts) | B Prior Art Commercial Powder (Parts) |
|---|---|---|
| Organic Carrier Liquid | 39.1 | — |
| Sodium Tripolyphosphate | 22.8 | 35.3 |
| Sodium Carbonate | 9.5 | 20.0 |
| Sodium Sulfate | — | 18.0 |
| Nonionic Surfactant(1) | 2.8 | 3.5 |
| Sodium Silicate (1:2.4) | 7.6 | 10.0 |
| Silica Anti-filming Agent | 4.8 | — |
| Sodium Perborate Monohydrate | 4.8 | 4.8 |
| Bleach Activator(2) | 2.4 | 2.4 |
| Sodium Polyacrylate(3) | 6.2 | — |
| Moisture | <1 | 13.0 |
| | 99.5 | 101.6 |

(1)Tergitol MDS-42. from Union Carbide Corporation.
(2)Tetraacetylethylene diamine (TAED).
(3)Alcosperse 130D. from Alco Chemicals.

The two above formulations (A) and (B) were tested and compared for film and spot formation. The formulations were tested in a Kenmore automatic dishwasher using the procedure described in ASTMD 3566-79, except that only four cleaning cycles are used. The filming and spotting were evaluated according to the following scales:

Film Rating Scale

1. Best, no apparent film
2. Filming slight, becoming apparent
3. Noticeable film, increasing
4. Continued increase of significant film
5. Filming becoming excessive
6. Filming high, excessive buildup
7. Continued increase of excessive film.

Spot Rating Scale

A. Best-no spots
B. Very few spots apparent
C. Distinct
D. Significant coverage approximately 50%.

The above compositions were tested cleaning glass tumblers.

The ASTM Method D3556-79 for the deposition on glassware during mechanical dishwashing, as mentioned above, was used to evaluate the buildup of spots and film on glassware. 42 grams of the invention nonaqueous liquid detergent composition (A) and 50 grams of the commercial powder detergent composition (B) are used in each test. All testing reported was done in Kenmore Model 587.1548580 and/or model 587.1546580 Automatic Dishwasher. The water wash temperature is 120° F. and the water has 300 ppm hardness.

The results are reported below.

| Formulation | Spot | Film |
|---|---|---|
| Invention Formulation (A) | B | 3 |
| Commercial Formulation (B) | B | 4 |

The commercial powder gave more film than the invention nonaqueous liquid ADD composition. There was no difference in the spot scores.

EXAMPLE 2

Following the teachings of the present invention, nonaqueous liquid automatic dishwasher detergent compositions were formulated using the below named ingredients in the amounts indicated.

| | A Wt. % | B Wt. % | C Wt. % | D Wt. % |
|---|---|---|---|---|
| Organic Carrier Liquid[1] | 36.3 | 34.6 | 41.0 | 39.1 |
| NaTPP | 41.0 | 38.9 | 24.0 | 22.8 |
| Sodium Carbonate | — | — | 10.0 | 9.5 |
| Sodium Silicate | 13.7 | 12.9 | 8.0 | 7.6 |
| Surfactant[2] | 2.6 | 2.4 | 3.0 | 2.8 |
| Silica Anti-filming Agent[3] | — | — | — | 4.8 |
| Sodium Polyacrylate[4] | — | 5.2 | 6.5 | 6.2 |
| Bleaching Agent[5] | 4.3 | 4.0 | 5.0 | 4.8 |
| Bleach Activator[6] | 2.1 | 2.0 | 2.5 | 2.4 |
| | 100.0 | 100.0 | 100.0 | 100.0 |
| (Dose Size, Grams) | (47) | (49.6) | (40) | (42) |

[1]Methoxy polyethylene glycol (Carbowax MPEG 350) from Union Carbide.
[2]Tergitol MDS which is a nonionic surfactant from Union Carbide.
[3]Syloid 244.
[4]Alcosperse 130D, Alco.
[5]Sodium perborate monohydrate (Interox).
[6]Tetraacetylethylenediamine (TAED).

The above formulations A, B, C and D were tested following the test and evaluation procedure of Example 1. The tests were carried out at 120° F. with 100 ppm water hardness, or 120° F. with 300 ppm water hardness.

There were ten glass tumblers used in each test and the average values are reported. The test result performance profile are reported in the below table.

| | Performance Profile | | | | | | | |
|---|---|---|---|---|---|---|---|---|
| | A | | B | | C | | D | |
| Cycle | Spot | Film | Spot | Film | Spot | Film | Spot | Film |
| I. ASTM Test 100 ppm hard water, °F. | | | | | | | | |
| 1 | CD | 2 | B | 2 | BC | 2 | — | |
| 2 | DE | 2 | — | | AB | 2 | — | |
| 3 | DE | 2 | — | | AB | 2 | — | |
| 4 | D | 2 | — | | AB | 2 | — | |
| II. ASTM Test 300 ppm hard water, 120° F. | | | | | | | | |
| 1 | — | | — | | B | 4 | AB | 2, 3 |
| 2 | — | | — | | B | 4, 5 | AB | 2, 3 |
| 3 | — | | — | | B | 4, 5 | AB | 3 |
| 4 | — | | — | | B | 4 | AB | 3 |

The Test I (100 ppm hardness, 120° F.) data show that the polyacrylate in the formulations B and C provides substantially improved spot performance as compared to the comparison formulation A without polyacrylate. The film performance for the formulations A, B and C were similar.

The Test II (300 ppm hardness, 120° F.) show that the addition of silica anti-film agent to invention formulation D, which also contains polyacrylate, improves the spot and film performance as compared to the formulation C which contains only the polyacrylate.

The Test I data show that the addition of polyacrylate to the formulation improves spot performance, and the Test II data show that the further addition of silica improves spot and film performance.

EXAMPLE 3

A nonaqueous liquid automatic dishwashing detergent composition is formulated from the following ingredients in the amounts specified.

| Component | Invention Formulation Alumina Anti-film Agent Wt. % |
|---|---|
| Organic Carrier Liquid[1] | 38.00 |
| NaTPP | 27.84 |
| Sodium Carbonate (Anhydrous) | 10.00 |
| Sodium Silicate (1/2.35–43.5%) | 12.00 |
| Poly Tergent SLF-18[2] | 1.00 |
| Alumina Anti-filming Agent[3] | 2.00 |
| Sodium Perborate Monohydrate | 4.8 |
| Bleach Activator[4] | 2.4 |
| Knapsack LPKN-158 Foam Depressant | 0.16 |
| | 100.00 |

[1]Organic Carrier Liquid is Polyethylene Glycol 300 (Union Carbide).
[2]Ethoxylated propoxylated fatty alcohol (Olin Chemical).
[3]Aluminum oxide C has a particle size of 0.02 microns and is available from DeGussa Co.
[4]TAED.

The formulation is tested by washing glassware at 130° F. in hard water (300 ppm hardness) in a Kenmore automatic dishwasher to clean glass tumblers using the procedure described in ASTMD 3566-79, except that only four cleaning cycles are used. The spotting and filming are evaluated as in Example 1. The clean tumblers are found to have reduced film as compared to commerical powder formulations not containing alumina anti-film agent.

EXAMPLE 4

The above Example 3 is repeated with the difference that 2.00 wt. % titanium dioxide is substituted for the alumina anti-filming agent. The formulation is tested by washing glassware at 130° F. in hard water (300 ppm hardness) as before. The clean tumblers are found to have reduced film as compared to commercial powder formulations not containing titanium dioxide anti-film agent.

The nonaqueous liquid automatic dishwasher detergent compositions of the present invention provide improved film and/or improved spot properties on glassware and dishware.

The invention is not to be limited by the above disclosure and examples which are given as illustrations only. The invention is to be interpreted in accordance with the below claims.

What is claimed is:

1. A pourable nonaqueous liquid automatic dishwasher detergent composition comprising approximately by weight:

(a) 20 to 60% organic carrier liquid selected from the group consisting essentially of polyethylene glycol, polypropylene glycol, propylene carbonate and methoxy propylene glycol and mixture thereof;
(b) 20 to 60% inorganic or organic detergent builder;
(c) 5 to 30% sodium silicate;
(d) 0 to 25% alkali metal carbonate;
(e) 0.1 to 3% water-dispersible organic nonionic detergent active material;
(f) 0 to 6% foam depressant;
(g) 3 to 15% peroxygen bleach compound;
(h) 0 to 8% bleach activator; and
(i) a nonabrasive 0.5 to 10% amount of an anti-filming agent which is a member selected from the group consisting of silica, alumina, titanium dioxide and mixtures thereof having a particle size of 0.01 to 10 microns.

2. The composition of claim 1 wherein the peroxygen bleach compound is a member selected from the group consisting of sodium perborate, potassium monopersulfate, sodium percarbonate and monoperoxyphthalate.

3. The composition of claim 1 additionally containing 2 to 25% of a water soluble polyacrylic acid polymer or salt anti-spotting agent.

4. A pourable nonaqueous liquid automatic dishwasher detergent composition comprising approximately by weight:
(a) 25 to 55% organic carrier liquid selected from the group consisting essentially of polyethylene glycol, polypropylene glycol, propylene carbonate and methoxy propylene glycol and mixture thereof;
(b) 20 to 55% alkali metal tripolyphosphate;
(c) 7 to 26% sodium silicate;
(d) 5 to 20% alkali metal carbonate;
(e) 0.5 to 3% water dispersible organic nonionic detergent active material;
(f) 0.1 to 5% foam depressant;
(g) 4 to 12% of a peroxygen bleach compound;
(h) 2 to 6% of a bleach activator; and
(i) a nonabrasive 1 to 8% amount of an anti-filming agent which is a member selected from the group consisting of silica, alumina, titanium dioxide and mixtures thereof having a particle size of 0.01 to 8 microns.

5. The composition of claim 4 additionally containing 2 to 25% of a polyacrylic acid polymer or salt anti-spotting agent which has the formula

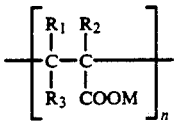

wherein $R_1$, $R_2$ and $R_3$ can be the same or different and can be hydrogen, $C_1$–$C_4$ lower alkyl, M represents hydrogen, or an alkali metal, n=5 to 1000 and the polymer has a molecular weight of 1000 to 100,000.

6. The composition of claim 4 wherein the bleach activator is tetraacetylethylenediamine (TAED).

7. The composition of claim 4 wherein the anti-filming agent is silica.

8. The composition of claim 4 wherein the anti-filming agent is alumina.

9. The composition of claim 4 wherein the anti-filming agent is titanium dioxide.

10. A pourable liquid nonaqueous dishwasher detergent composition comprising approximately by weight;
(a) 30 to 45% organic carrier liquid selected from the group consisting essentially of polyethylene glycol, polypropylene glycol, propylene carbonate and methoxy propylene glycol and mixture thereof;
(b) 20 to 45% alkali metal tripolyphosphate;
(c) 10 to 24% sodium silicate;
(d) 5 to 15% alkali metal carbonate;
(e) 0.5 to 4.5% foam depressant;
(f) 1 to 3% water dispersible organic nonionic detergent;
(g) 4 to 12% peroxygen bleach compound;
(h) a nonabrasive 1.5 to 6% amount of an anti-filming agent which is a member selected from the group consisting of silica, alumina, titanium dioxide and mixtures thereof having a particle size of 0.01 to 8.0 microns; and
(i) 4 to 20% water soluble polyacrylic acid polymer or salt.

11. The composition of claim 10 wherein the water soluble polyacrylic acid polymer or salt anti-spotting agent has the formula

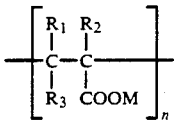

wherein $R_1$ and $R_3$ are hydrogen, and $R_2$ is hydrogen or methyl, M represents hydrogen, sodium or potassium, n=10 to 500 and the polymer has a molecular weight of 1500 to 50,000.

12. The composition of claim 10 wherein the polyacrylic acid polymer or salt has a molecular weight of about 2000.

13. The composition of claim 10 wherein the polyacrylic acid polymer or salt has a molecular weight of about 4500.

14. The composition of claim 10 wherein the silica anti-filming agent contains about 0.1 to 5% of alumina, based on weight of silica.

15. The composition of claim 10 wherein the anti-filming agent has a particle size of about 0.01 to 5 microns.

16. A method for cleaning soiled glassware and dishware which comprises contacting the glassware and dishware in an automatic dishwashing machine in an aqueous washbath having dispersed therein an effective amount of the composition of claim 4 to obtain clean glassware and dishware with reduced film and/or spot.

17. A method for cleaning soiled glassware and dishware which comprises contacting the soiled glassware and dishware in an automatic dishwashing machine in an aqueous wash bath having dispersed therein an effective amount of the composition of claim 7 to obtain clean glassware and dishware with improved film and/or spot.

* * * * *